United States Patent [19]

Roberts

[11] Patent Number: 4,971,275

[45] Date of Patent: Nov. 20, 1990

[54] LIGHTWEIGHT, FLEXIBLE HOLDER FOR SCUBA TANKS AND THE LIKE

[76] Inventor: John C. Roberts, 7638 Maple Louise Ln., Orlando, Fla. 32819

[21] Appl. No.: 385,215

[22] Filed: Jul. 25, 1989

[51] Int. Cl.[5] ..... A47G 23/02

[52] U.S. Cl. ..... 248/152; 211/60.1; 211/71; 211/903; 248/160; 248/176; 248/671; 294/151

[58] Field of Search ..... 248/152, 154, 160, 174, 248/176, 671, 676, 678, 310, 903, 313, 146; 206/564, 563, 562; 211/60.1, 71, 126; 294/151

[56] References Cited

U.S. PATENT DOCUMENTS

| | | | |
|---|---|---|---|
| 1,516,911 | 11/1924 | Canfield et al. | 248/903 X |
| 2,936,992 | 5/1960 | Browning | 248/313 |
| 3,298,646 | 1/1967 | Van Buren, Jr. | 248/903 X |
| 3,786,932 | 1/1974 | Smith | 211/70.1 |
| 4,182,455 | 1/1980 | Zurawin | 211/71 |
| 4,503,978 | 3/1985 | Smit et al. | 211/60.1 X |
| 4,555,083 | 11/1985 | Carter | 248/154 X |
| 4,754,996 | 7/1988 | Tecca et al. | 294/151 |
| 4,840,276 | 6/1989 | George | 206/564 X |
| 4,848,714 | 7/1989 | Ziaylek, Jr. et al. | 248/313 |

*Primary Examiner*—Ramon O. Ramirez

*Attorney, Agent, or Firm*—Duckworth, Allen, Dyer and Doppelt

[57] ABSTRACT

A holder for SCUBA tanks or other similar cylindrical articles for storing such tanks along the deck of a boat or the like is molded from a unitary sheet having at least one concavity extending from the upper surface interiorly between the lateral sides, the sheet being sufficiently flexible that the weight of a SCUBA tank stored within the concavity causes flexure of the sheet so that the concavity rests on the supporting surface.

17 Claims, 2 Drawing Sheets

LIGHTWEIGHT, FLEXIBLE HOLDER FOR SCUBA TANKS AND THE LIKE

BACKGROUND OF THE INVENTION

The present invention is a lightweight, flexible holder for SCUBA tanks and the like, which is portable and may be easily placed upon a boat deck or similar supporting surface to permit SCUBA tanks to be easily stored, and prevented from rolling about the supporting surface.

There are a number of portable stacking holders for cylindrical storage containers described in the prior art. For example, in U.S. Pat. No. 3,786,932 Smith describes a plastic drill core tray having a plurality of longitudinally extending channels disposed in side-by-side relationship, in order to store drilling cores. A similar drilling core holding arrangement is described by Guenard in U.S. Pat. No. 3,581,929. In Canadian Pat. No. 972,302, there is described a foam plastic core tray having individual flutes, each of which is arc-shaped to accommodate a cylindrical core sample, and in which the tray is described as being fabricated from plastic.

Other prior art of interest includes the following: U.S. Pat. No. 3,926,321 to Trebilcock (a stacking aid for cylindrical containers including a substantially rectangular framework having spaced openings to receive an arcuate portion of the cylindrical container, to prevent movement); U.S. Pat. No. 3,019,916 to Malcher (a portable drum rack which is symmetrical to a center horizontal plane, and is adapted to support a pair of drums in a stackable fashion); British Patent Specification No. 1,580,032 to Partington (double sided spacer used between layers of stacked casks or drums); and French Pat. No. 2,432,953 to Charlin (cradle for a gas bottle includes notched profiled wedged elements which are collapsible for easy storage and for use in a car boot).

There is a need for a low cost, lightweight and flexible holder for SCUBA tanks and the like, which may be used to prevent SCUBA tanks from rolling about the deck of a boat or similar supporting surface.

SUMMARY OF THE INVENTION

The present invention comprises a holder for SCUBA tanks or other similar cylindrical articles for storing those tanks along the deck of a boat or the like, and is fabricated from a unitary sheet molded into a configuration having an upper surface, dependent peripheral sides extending lateral to the upper surface, and at least one concavity extending from the upper surface interiorally between the lateral sides. The sheet has sufficient flexibility that the weight of a SCUBA tank or other articles stored within the concavity causes flexure of the sheet so that the concavity rests on any supporting surface upon which the holder is placed.

Suitably, the unitary sheet is molded from a high impact plastic which is translucent, and is relatively impervious to corrosion and ultra violet radiation. It is also preferred that the sheet comprise at least two concavities, each of which is dimensioned to receive a single SCUBA tank, so that the weight of both SCUBA tanks are such that the bottom of the concavities engage the supporting surface when the tanks are stored. To facilitate holding the tanks in place, the unitary molded sheet preferably has plural ribs molded into the periphery of each concavity with the ribs extending downwardly and engageable with the supporting surface. The ribs extend generally parallel with each other and generally normal to the axial direction of the cylindrical concavities.

It is also preferred that the molded sheet be fabricated in a unitary manner with a peripheral flange extending laterally from the extremity of the dependent peripheral sides, the flange extending outwardly and generally parallel with both the upper surface of the holder and with the supporting surface upon which the holder rests.

In general, the concavities have a dimension less than the dimension of the depending sides, so that the concavity does not engage the supporting surface unless the SCUBA tanks or other articles are positioned within the concavities, to thereby cause flexure of the depending sides and engagement of the bottom surface of the concavity with the supporting surface, thereby further achieving the desired rigidity against sliding across the supporting surface. It will be understood, however, that the use of relatively thin gauge plastic material for the molded sheet permits the holder to be extremely lightweight and portable, while the degree of flexure achieved with the holder effectuates the engagement of the concavities with the supporting surface when loaded with the weight of the SCUBA tanks, thereby effectively relying upon the weight of the SCUBA tanks to achieve the necessary rigidity to prevent undesirable sliding across the support surface, i.e., a boat deck, when the boat is in heavy seas or is underway. To facilitate the desired flexure of the holder, as described above, it is also desirable that the peripheral sides be slightly tapered outwardly from the upper surface toward the peripheral flange.

THE DRAWINGS

DETAILED DESCRIPTION

A preferred embodiment of the lightweight, flexible holder for SCUBA tanks and the like in accordance with the present invention will now be described with reference to FIGS. 1–4.

Figure 1:
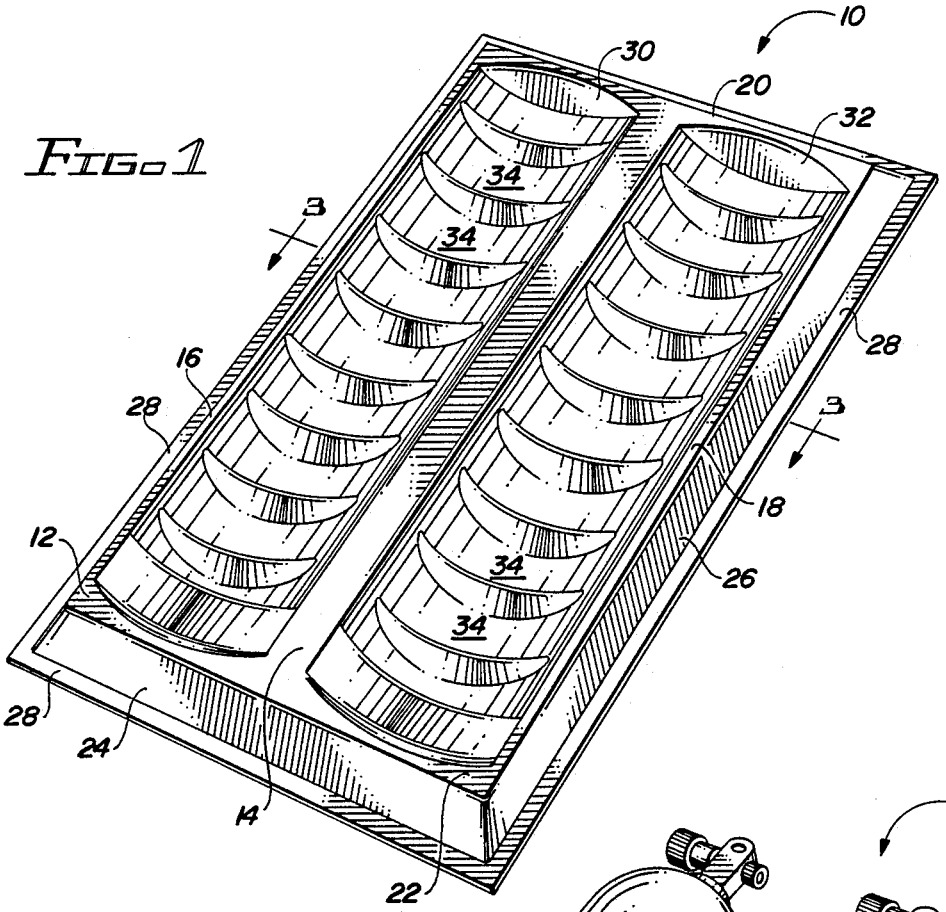
FIG. 1, is a top, perspective view illustrating the lightweight, flexible holder for SCUBA tanks in accordance with the present invention.
Figure 3:
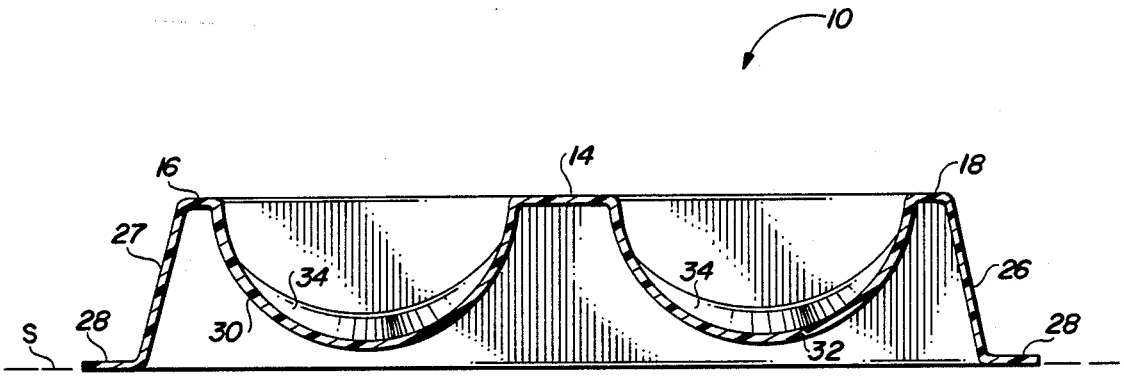
FIG. 3 is a cross sectional view of the holder shown in FIG. 1, taken along the lines 3–3.

Noting FIGS. 1 and 3, the holder, referred to generally by the reference numeral 10, comprises a unitary sheet molded from a high-impact plastic which is preferably translucent and relatively impervious to corrosion and ultra violet radiation. A suitable plastic material is LEXAN. The molded plastic sheet includes an upper surface 12 defined by a central surface rib 14, peripheral surface ribs 16 and 18 and end ribs 20 and 22. The sheet is molded so as to have peripheral, depending sides, including sides 24, 26 and 27 (the fourth side is not shown in FIG. 1, but opposes side 24). The sides 24, 26 and 27 extend lateral to the upper surface and include a pair of concavities 30, 32 extending from the upper surface interiorly between the lateral sides 26, 27. As is shown in FIG. 3, the concavities 30, 32 are shorter than the lateral sides 26, 27 so as to define a gap between bottom surfaces of the concavities 30, 32 and a supporting surface S when there are no SCUBA tanks or similar heavy articles loaded within the concavities.

As is further shown in FIGS. 1 and 3, the holder includes a peripheral flange surrounding and extending generally normal to the extremities of the peripheral sides 24, 26 and 27, the flange 28 lying generally in a plane parallel with the upper surface defined by surface ribs 14, 16, 18, 20 and 22 and with the flange adapted to lie parallel and along the supporting surface S upon which the holder 10 is placed. As is illustrated in FIG. 3, the peripheral sides 24, 26 and 27 are tapered slightly outwardly from the upper surface toward the peripheral flange 28. Each of the concavities 30, 32 includes plural ribs 34 molded into the periphery of the concavity, such that the ribs are engageable with the supporting surface S. Preferably, the ribs 34 extend generally parallel with each other and generally normal to the axial direction of the cylindrical cavities 30, 32.

Figure 4:
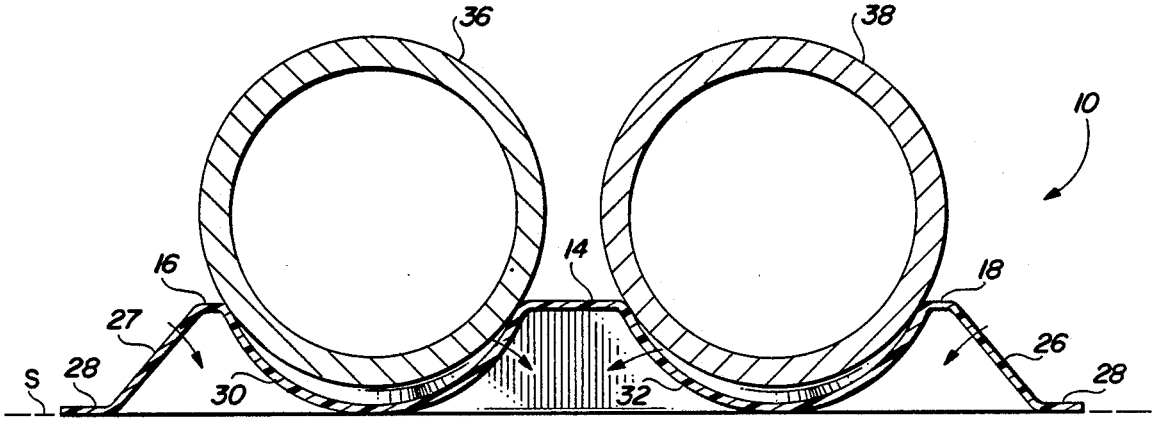
FIG. 4 is a cross sectional view like that of FIG. 3, taken along the lines 4—4 in FIG. 2.

In accordance with the present invention the sheet is of a gauge and material so as to impart sufficient flexibility when the weight of a SCUBA tank or other article is stored within the concavities 30, 32 so as to cause flexure of the sheet so that the concavity rests on the supporting surface S upon which the holder 10 is placed, as is described below with reference to FIGS. 2 and 4.

Figure 2:
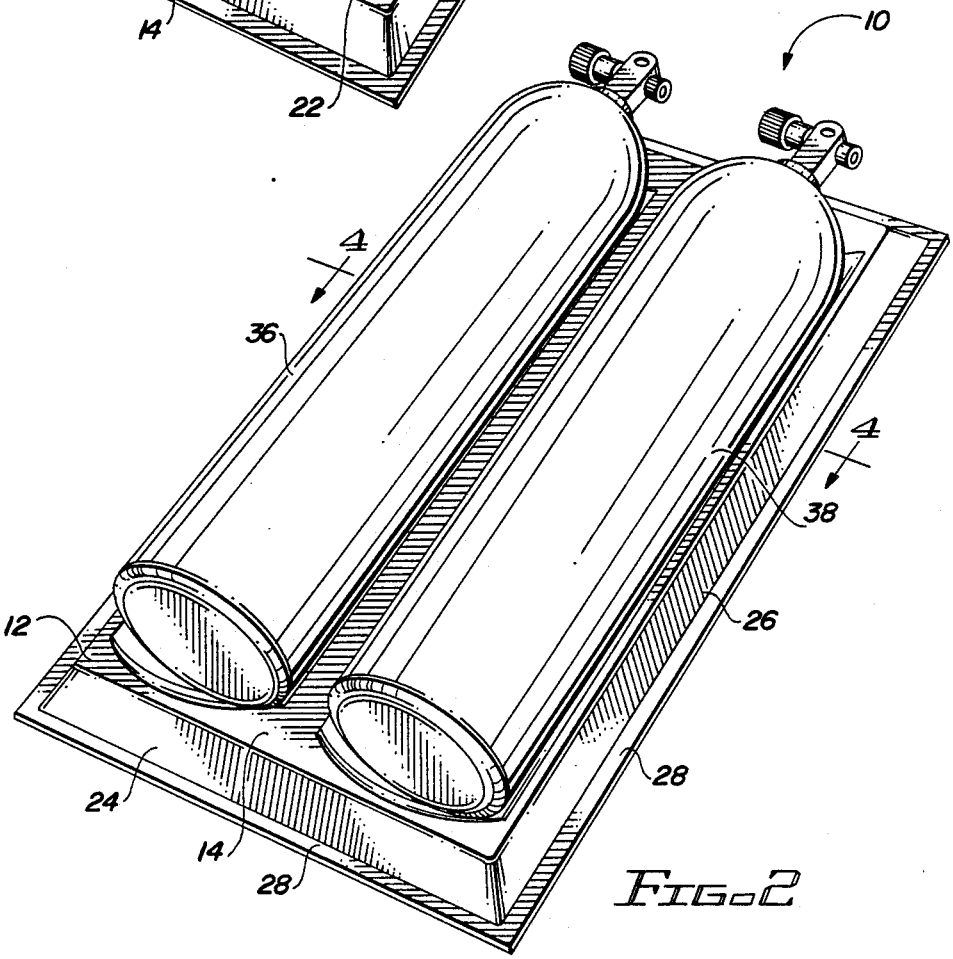
FIG. 2 is a top, perspective view like FIG. 1, illustrating the holder of the present invention loaded with a pair of SCUBA tanks.

Noting FIG. 2, a pair of SCUBA tanks 36 and 38 are respectively placed in the concavities 30 and 32. As is shown in FIG. 4, the weight of the SCUBA tanks 30, 36 causes inward flexure of the respective lateral sides 27, 26 and the inner surface rib 14 such that the bottom of each concavity 30, 32 rests upon the supporting surface S. Accordingly, when so loaded with the SCUBA tanks 36 and 38, a greater surface area of the holder 10 is engagement with the supporting surface S, thereby causing the entire arrangement to have increased drag against sliding.

It will thus be understood by those skilled in the art that the holder 10 provides an extremely lightweight, flexible arrangement for storing SCUBA tanks and similar heavy articles, which may be easily transported and yet upon being loaded, provides sufficient strength against sliding. It will of course be understood that holes may be drilled into the plastic sheet of the holder 10 to permit holding straps and similar additional mechanisms to be used as desired.

What is claimed is:

1. A holder for SCUBA tanks or other similar cylindrical articles for storing such tanks along the deck of a boat or the like, the holder comprising a unitary sheet molded into a configuration having an upper surface, plural depending sides extending laterally to the upper surface, and at least one concavity extending from the upper surface interiorly between the lateral sides, the sheet having sufficient flexibility that the weight of a SCUBA tank or other articles stored within the concavity causes flexure of the sheet so that the concavity rests on any supporting surface upon which the holder is placed.

2. The holder recited in claim 1 wherein the sheet comprises a high-impact plastic.

3. The holder recited in claim 2 wherein the plastic is translucent.

4. The holder recited in claim 2 wherein the sheet is relatively impervious to corrosion and ultra violet radiation.

5. The holder recited in claim 1 wherein the sheet comprises at least two concavities extending from the upper surface, and wherein the flexibility of the sheet is such that both concavities engage the supporting surface when a SCUBA tank or other article is stored within the concavities.

6. The holder recited in claim 5 further comprising plural ribs molded in the periphery of each concavity, and wherein the ribs are engageable with the supporting surface.

7. The holder recited in claim 6 wherein the two concavities are generally cylindrical and extend generally parallel along the holder.

8. The holder recited in claim 7 wherein the plural ribs extend generally parallel with each other and generally normal to the axial direction of the cylindrical concavities.

9. The holder recited in claim 8 wherein the depending sides extend completely around the holder.

10. The holder recited in claim 9 wherein the depending sides are all sufficiently flexible so as to flex in response to the weight of SCUBA tanks or other articles in the cylindrical concavities.

11. The holder recited in claim 10 wherein the upper surface comprises a space between the two adjacent cylindrical cavities.

12. The holder recited in claim 1 wherein the concavity has a dimension less than the dimensions of the depending sides, so that the concavity does not engage the supporting surface unless a SCUBA tank or other article is positioned within the concavity, to thereby cause flexure of the depending sides and engagement of the concavity with the supporting surface.

13. The holder recited in claim 1 further comprising a peripheral flange surrounding and extending generally normal to the extremities of the peripheral sides, the flange lying generally in a plane parallel with the upper surface, and adapted to lie along the supporting surface upon which the holder is placed.

14. The holder recited in claim 13 wherein the peripheral sides are tapered slightly outwardly from the upper surface toward the peripheral flange.

15. A holder for SCUBA tanks or other similar articles for storing such articles along the deck of a boat or the like, the holder comprising a unitary sheet molded into a configuration having an upper surface, peripheral depending sides extending lateral to the upper surface, at least one concavity extending from the upper surface exteriorly between the lateral sides, a peripheral flange surrounding and extending generally normal to the extremities of the peripheral sides, the flange lying generally in a plane parallel with the upper surface and adapted to lie along the supporting surface upon which the holder is placed, the sheet having sufficient flexibility that the weight of a SCUBA tank or other articles stored within the concavity causes flexure of the sheet so that the concavity rests on any supporting surface upon which the holder is placed.

16. The holder recited in claim 15 wherein the peripheral sides are tapered slightly outwardly from the upper surface toward the peripheral flange.

17. In combination: a supporting surface, a holder comprising a unitary sheet molded into a configuration having an upper surface positioned over the support surface, plural depending sides extending lateral to the upper surface and downwardly to the support surface, at least two concavities extending from the upper surface and generally parallel with each other, the concavities extending from the upper surface interiorly between the lateral sides and toward the support surface, the sheet having flexibility characteristics such that the weight of a SCUBA tank or other articles stored within each concavity causes flexure of the sheet so that the concavities rest on the support surface, and plural ribs molded into the periphery of each concavity, wherein the ribs are engageable with the support surface when the weight of a SCUBA tank or other article is stored within each concavity, and a SCUBA tank positioned in at least one of the concavities.

* * * * *